US007918487B2

(12) United States Patent
Lin

(10) Patent No.: US 7,918,487 B2
(45) Date of Patent: Apr. 5, 2011

(54) UNLOCK TRANSMISSION MECHANISM FOR ESCAPE DOOR

(75) Inventor: Ching-Tien Lin, Taipei Hsien (TW)

(73) Assignee: Thase Enterprise Co., Ltd., Hsin-Chung, Taipei Hsien (TW)

( * ) Notice: Subject to any disclaimer, the term of this patent is extended or adjusted under 35 U.S.C. 154(b) by 529 days.

(21) Appl. No.: 11/943,232

(22) Filed: Nov. 20, 2007

(65) Prior Publication Data

US 2008/0256995 A1 Oct. 23, 2008

(30) Foreign Application Priority Data

Apr. 18, 2007 (TW) ..... 96113586 A

(51) Int. Cl.
*E05B 65/10* (2006.01)
*E05B 65/00* (2006.01)

(52) U.S. Cl. ..... 292/92; 292/93

(58) Field of Classification Search ..... 292/92, 292/93; 70/92
See application file for complete search history.

(56) References Cited

U.S. PATENT DOCUMENTS

| | | | | |
|---|---|---|---|---|
| 4,427,223 | A * | 1/1984 | Godec et al. | 292/92 |
| 6,000,733 | A * | 12/1999 | Linder | 292/92 |
| 6,532,777 | B2 * | 3/2003 | Haeck et al. | 70/92 |
| 6,945,571 | B2 * | 9/2005 | Lin | 292/92 |
| 6,953,211 | B2 * | 10/2005 | Di Vinadio | 292/296 |
| 7,503,597 | B2 * | 3/2009 | Cohrs et al. | 292/92 |
| 7,641,244 | B2 * | 1/2010 | Lin | 292/92 |
| 2002/0153730 | A1 * | 10/2002 | Mandell et al. | 292/92 |
| 2004/0041411 | A1 * | 3/2004 | Cohrs et al. | 292/92 |
| 2005/0184531 | A1 * | 8/2005 | Lin | 292/92 |
| 2007/0273158 | A1 * | 11/2007 | Berger | 292/92 |

* cited by examiner

*Primary Examiner* — Carlos Lugo
(74) *Attorney, Agent, or Firm* — Shoemaker and Mattare

(57) ABSTRACT

An unlock transmission mechanism for escape doors is disclosed, including a base, a transmission member, a first drive unit and a second drive unit, wherein the transmission member, the first drive unit and second drive unit are all disposed on the base, and the transmission member is actuated to move relative to the first drive unit and the second drive unit, respectively. In the case that the unlock transmission mechanism is to be installed in an escape door that has a different installation orientation, the transmission member and the first drive unit provided therein have the characteristics of multi-directional changeability, thereby enabling flexible installation of the escape door lock and eliminating the necessity to replace an existing door handle mechanism as encountered in the prior art.

9 Claims, 7 Drawing Sheets

UNLOCK TRANSMISSION MECHANISM FOR ESCAPE DOOR

BACKGROUND OF THE INVENTION

1. Field of the Invention

The present invention relates to a door lock apparatus, and more particularly, to an unlock transmission mechanism applicable to escape doors or the like which facilitates easy and direct exit therefrom.

2. General Background

For maximum safety an escape door requires a latch that is simply and quickly operated yet is effective to resist opening by any person on the outside in case of a fire or forced entry. In short, safety with respect to these kinds of escape doors, and latches therefor, involves the dual consideration of easy exit for the occupant but difficult entry in undesired situations.

FIG. 1 depicts a basic construction of a known escape door 1 including a door handle mechanism 6, a push handle mechanism 5, an unlock transmission mechanism 2, an upper bolt link mechanism 4 and a lower bolt link mechanism 3. The door handle mechanism 6, the push handle mechanism 5, the upper bolt link mechanism 4 and the lower bolt link mechanism 3 are all connected to the unlock transmission mechanism 2, enabling the door handle mechanism 6 to move relative to the upper bolt link mechanism 4 and the lower bolt link mechanism 3 through the unlock transmission mechanism 2, and also the push handle mechanism 5 to move relative to the upper bolt link mechanism 4 and the lower bolt link mechanism 3 through the unlock transmission mechanism 2. Moreover, the push handle mechanism 5, the unlock transmission mechanism 2, the upper bolt link mechanism 4 and the lower bolt link mechanism 3 are disposed on the same side of the escape exit door, while the door handle mechanism 6 is installed on an opposite side thereof.

FIG. 2 is an exploded diagram illustrating an unlock transmission mechanism for escape doors as depicted in FIG. 1. The unlock transmission mechanism 2 for escape doors consists of a base 20; a second drive unit 22 having a base body 220 and two turning portions 221, wherein the base body 220 is fixedly disposed on the base 20, each of the two turning portions 221 being pivotally connected to the base body 220 respectively at corresponding positions and one end of each of the two turning portions 221 being coupled to one another by a spring; a transmission member 21 having a sliding board 210 and two detent protruding cylinders 211, wherein the sliding board 210 is slidably disposed within the second drive unit 22 of the base body 220, and the two detent protruding cylinders 211 are each disposed at two ends of the sliding board 211 with an interval therebetween larger than a largest distance between the tips of the two turning portions 221; a first drive unit 23 having a driving portion 230 and a pivot portion 231, the driving portion 230 being pivoted on the base 20 via the pivot portion 231 and one end thereof moving relative to the sliding board 210 of the transmission member 21, wherein two symmetrical limiting protrusions 200 are each disposed on the base 20 at positions close to the two sides of the pivot portion 231 respectively, for limiting rotation of the driving portion 230 within the range of relative movement to the sliding block, wherein the pivot portion 231 moves relative to the door handle mechanism 6 of the escape door.

When the door handle is rotated by a user, the door handle mechanism 6 moves relative to the transmission member 21 via the first drive unit 23. Conversely, when the door handle is pressed by the user, the push handle mechanism 5 moves relative to the transmission member 21 via the second drive unit 22. The relative movement is actuated by rotating the two turning portions 221 to push the two detent protruding cylinders 211 located on the sliding board 21 to move the sliding board 21, thereby transmitting the relative movement to the upper bolt link mechanism 4 and the lower bolt link mechanism 3 coupled thereto.

As describe above, the driving portion 230 and the pivot portion 231 of the first drive unit 23 are not limited in position on the base 20, therefore, when the first drive unit 23 moves relative to the door handle mechanism 6 of the door lock via the pivot portion 231, the door handle mechanism 6 needs to have a limit function in position and thus imposes a limitation on the design of installation orientation.

FIG. 2B illustrates an unlock transmission mechanism 2*a*, 2*b* being installed in an escape door at opposite directions to respectively correspond to the door handle mechanism 6*a*, 6*b* installed on the other side of the escape door 1. To open the escape door 1 on its left side as indicated in FIG. 2B, the door handle mechanism 6*a* is rotated counterclockwise to transmit relative movement to the unlock transmission mechanism 2*a*. Conversely, to open the escape door 1 on its right side, the door handle mechanism 6*a* is rotated clockwise to transmit relative movement to the unlock transmission mechanism 2*b*. As can be seen from the above, the rotating orientation of the door handle mechanism 6*a*, 6*b* is configured to be opposite to one another to be installed in an escape door or the like, causing inconveniences in the installation and usage as well as increased material costs.

A need thus exists for a door lock apparatus for escape doors or the like, which can improve on the defects of prior escape door locks in actual usage.

SUMMARY OF THE INVENTION

The present invention has been made in view of the above circumstances, and, as such, a primary objective of the present invention is to provide a multi-directional unlock transmission mechanism that permits flexible installation in an escape door having different orientation for installation.

Another objective of the present invention is to provide a multi-directional unlock transmission mechanism that is applicable to a single-mode door handle mechanism for escape doors or the like.

In order to achieve the above and other objectives, the present invention provides an improved door lock apparatus for escape doors having an unlock transmission mechanism capable of providing multi-directional installation without having to replace an existing door handle mechanism, which is accomplished by utilizing a frame portion built in a driving portion and a transmission portion of a first drive unit provided therein that has the characteristics of directional changeability and linked relative movement. The unlock transmission mechanism for escape doors consists of a base; a transmission member having a sliding block slidably disposed on the base and a detent portion formed on the sliding block, wherein the sliding block has a ring-shaped frame portion and a plane portion formed on the frame portion; a first drive unit having a driving block pivoted on the base corresponding to the frame portion and a limiting member disposed on the base to limit the moving range of the driving block, and further push the frame portion by rotating the driving block along an inner edge thereof; and a second drive unit having a base body disposed on the base and covering the plane portion, and two turning portions pivoted on the base at opposite positions to push and move the detent portion by rotating at least one side of the turning portion.

According to the aspect of the present invention, the limiting member is disposed at an upper position corresponding to the direction in which the base is disposed, wherein the driving block has a driving portion pivoted on the base, a limiting portion and a pivot portion having two ends thereof each connected to the driving portion and the limiting portion respectively, for allowing the driving portion to push the sliding block by rotation to move relative to the transmission member, wherein the rotating range of the driving block is limited by the coupling of the detent portion of the first drive unit to the limiting portion.

The turning portions of the second drive unit are arrow (<) shaped protrusions and pivoted to the base body via the turning point of the arrow (<) shaped turning portions.

The unlock transmission mechanism further comprises an elastic element connected to an end of each of the two turning portions to allow for flexible positioning, wherein the elastic element is a spring. The frame portion thereof comprises a limiting groove connected to the base for limiting the moving range of the sliding block.

Accordingly, when the unlock transmission mechanism is installed in an escape door that has different orientation for installation, the characteristics of multi-directional changeability and linked relative movement of the transmission member and the first drive unit provided therein can achieve multi-directional installation without having to replace an existing door handle mechanism of an escape door or the like.

In contrast to the conventional latch mechanism for escape doors that are built to install and coordinate with a mated door handle mechanism at fixed direction, the unlock transmission mechanism for escape doors of the present invention is characterized by having a multi-directional unlock transmission mechanism that enables the door lock to be installed from different direction with door handle mechanisms of mated structures as required, thereby eliminating the necessity to replace an existing door handle mechanism because the limitation of the fixed orientation of installation that are commonly seen and constructed in conventional escape door locks. Accordingly, the present invention improves and offers advantages over prior techniques by providing a multi-directional unlock transmission mechanism that helps reduce costs effectively and has high industrial applicability.

BRIEF DESCRIPTION OF THE DRAWINGS

The foregoing and additional features and characteristics of the present invention will become more apparent from the following detailed description considered with reference to the accompanying drawings, wherein.

DETAILED DESCRIPTION OF PREFERRED EMBODIMENT

Figure 1:
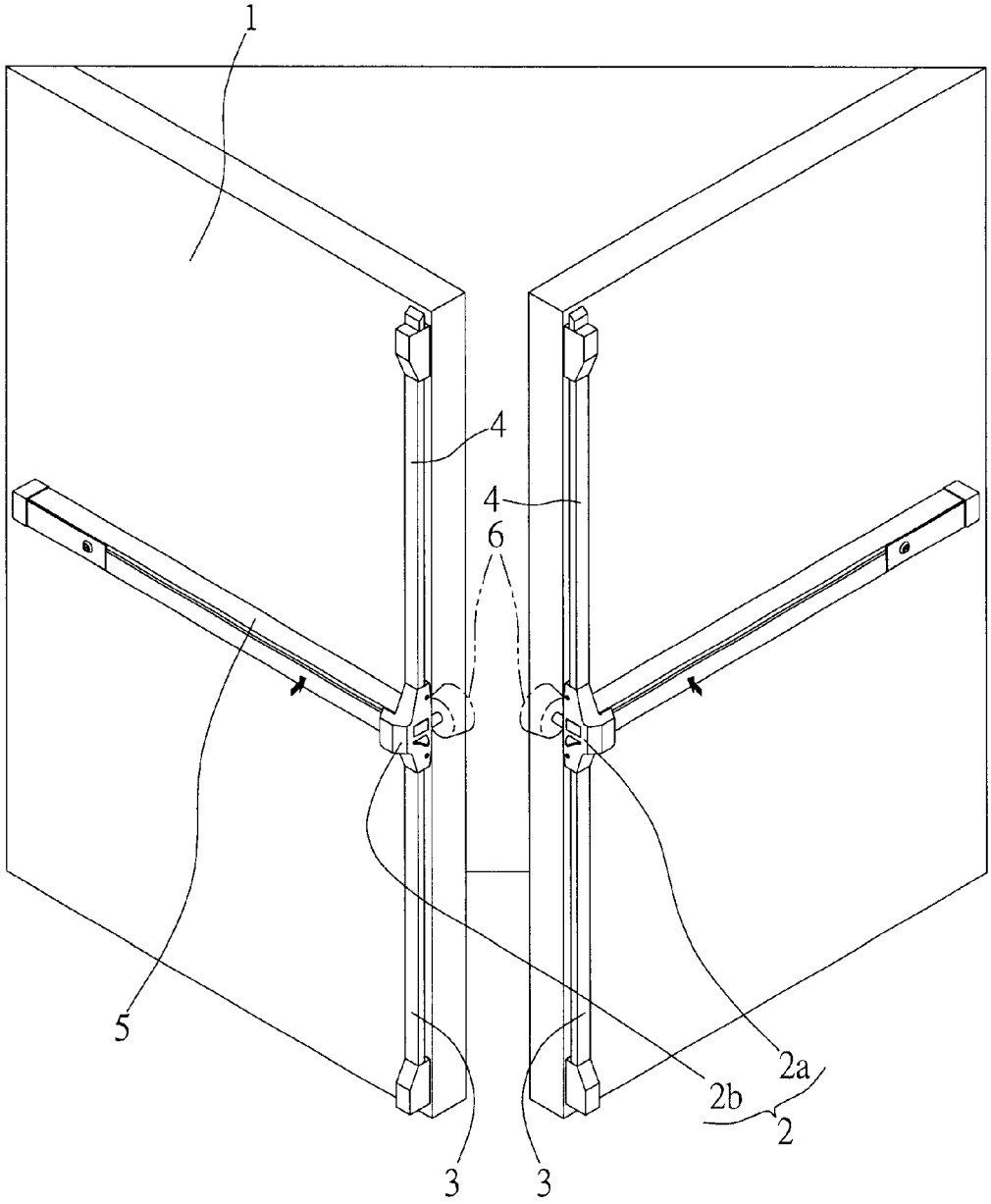
FIG. 1 (PRIOR ART)
FIG. 1 (PRIOR ART) represents a perspective view illustrating a conventional escape door lock apparatus.
Figure 2A:
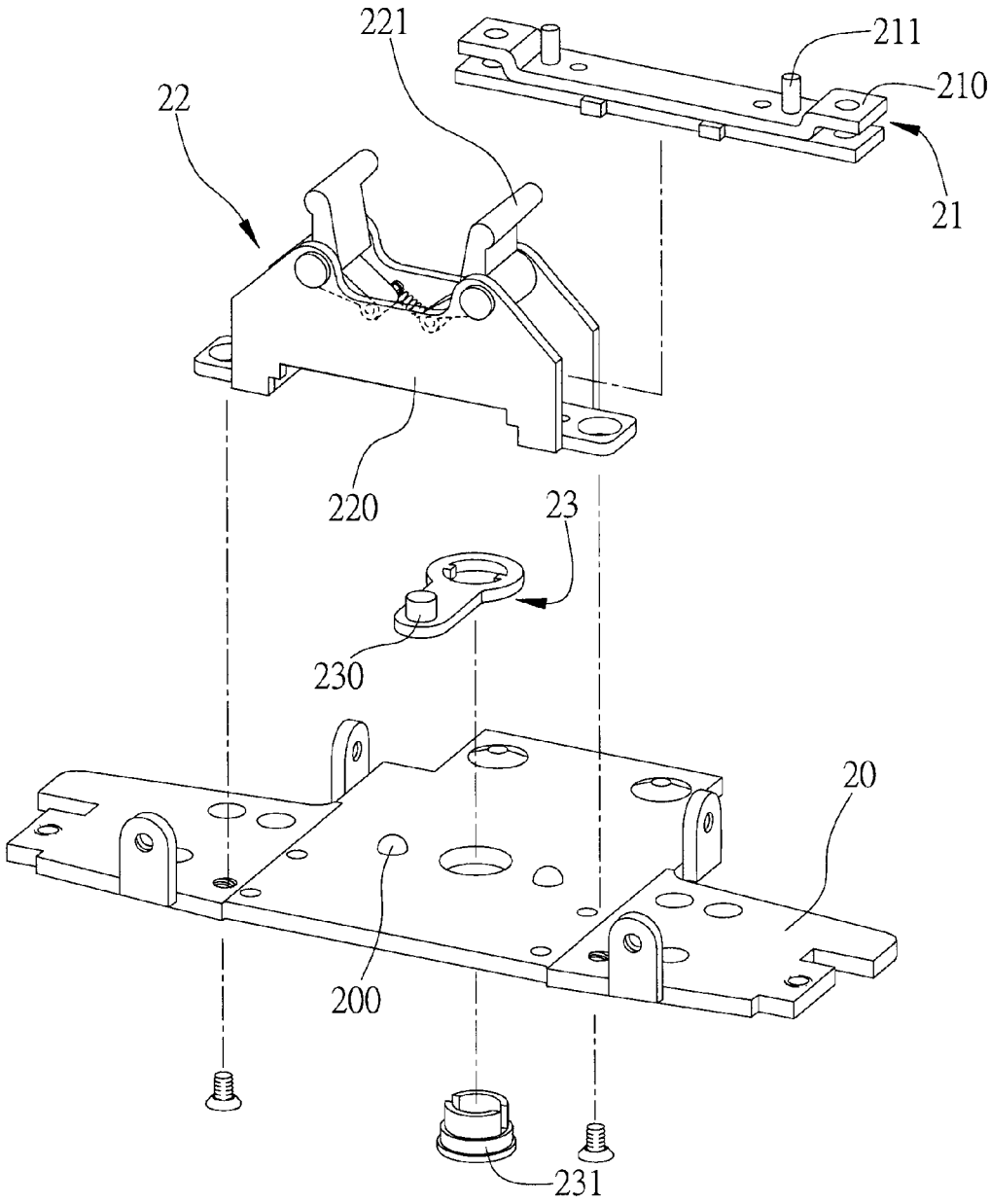
FIG. 2A (PRIOR ART)
FIG. 2A (PRIOR ART) represents an exploded diagram illustrating an unlock transmission mechanism of a conventional escape door lock.
Figure 2B:
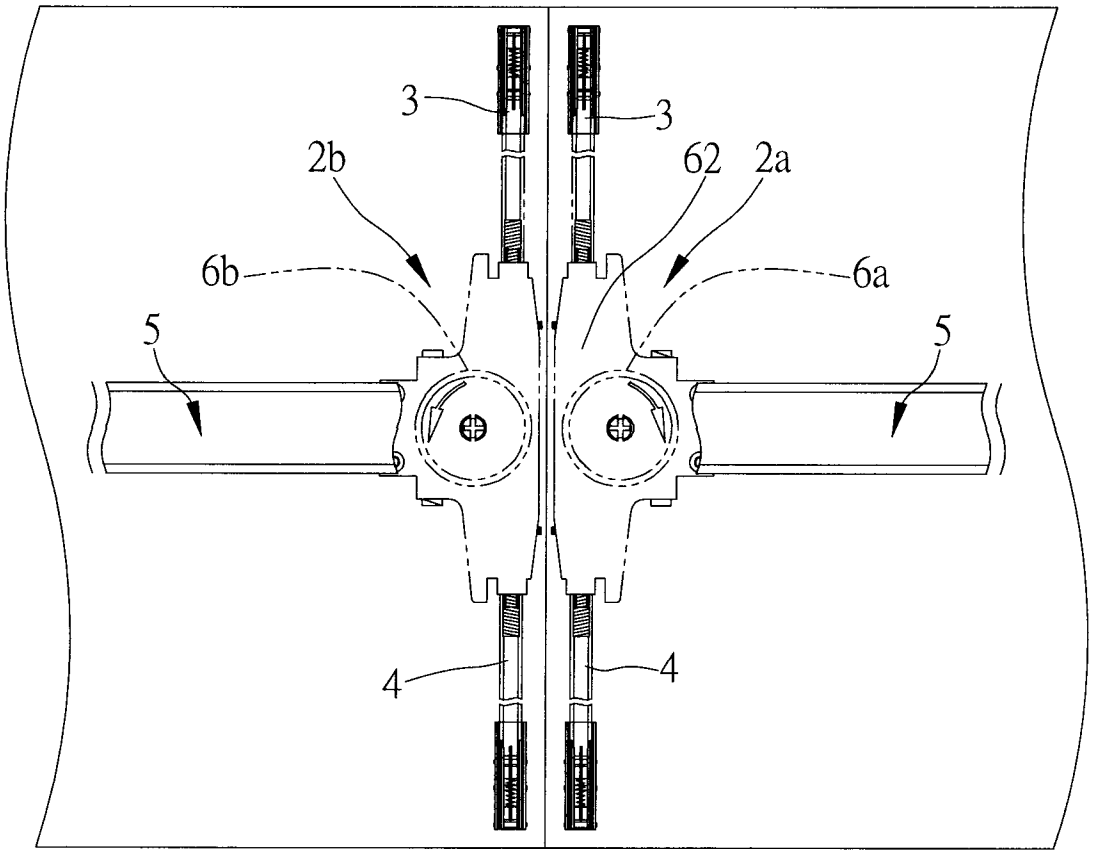
FIG. 2B (PRIOR ART)
FIG. 2B (PRIOR ART) represents a perspective view illustrating an unlock transmission mechanism of a conventional escape door lock in coordination with a door handle mechanism having different rotating orientation.

The present invention is described in the following so that one skilled in the pertinent art can readily understand other advantages and effects of the present invention. Note that the accompanied drawings are simplified figures illustrating the basic concept of the present invention, and the elements shown in the drawings are only exemplary but not the actual number, shape or dimensions of the elements, which are intended to be illustrative but not limitive to the invention. The unlock transmission mechanism according to the embodiment of the present invention is applicable to an escape door or the like.

Figure 3:
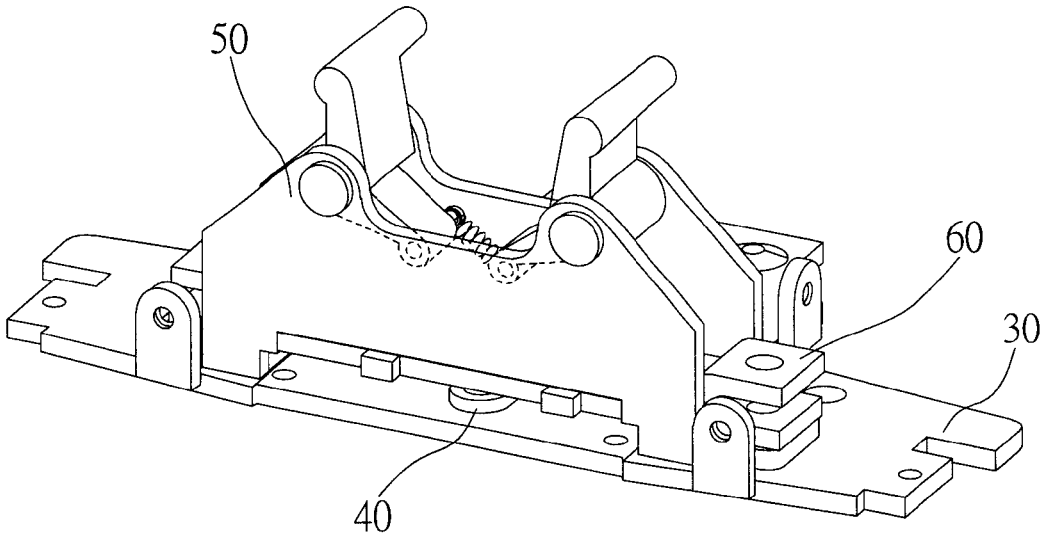
FIG. 3 represents a cross sectional assembled view illustrating an unlock transmission mechanism for escape doors according to the present invention.

Referring to FIG. 3, the unlock transmission mechanism 2 for escape doors in this embodiment consists of a base 30; a transmission member 60 slidably disposed on the base 30; a first drive unit 40 pivoted on the base 30 at a position close to the center thereof and moving relative to the transmission member 60; and a second drive unit 50 fixedly disposed on the base 30 to cover on and move relative to the transmission member 60.

Figure 4:
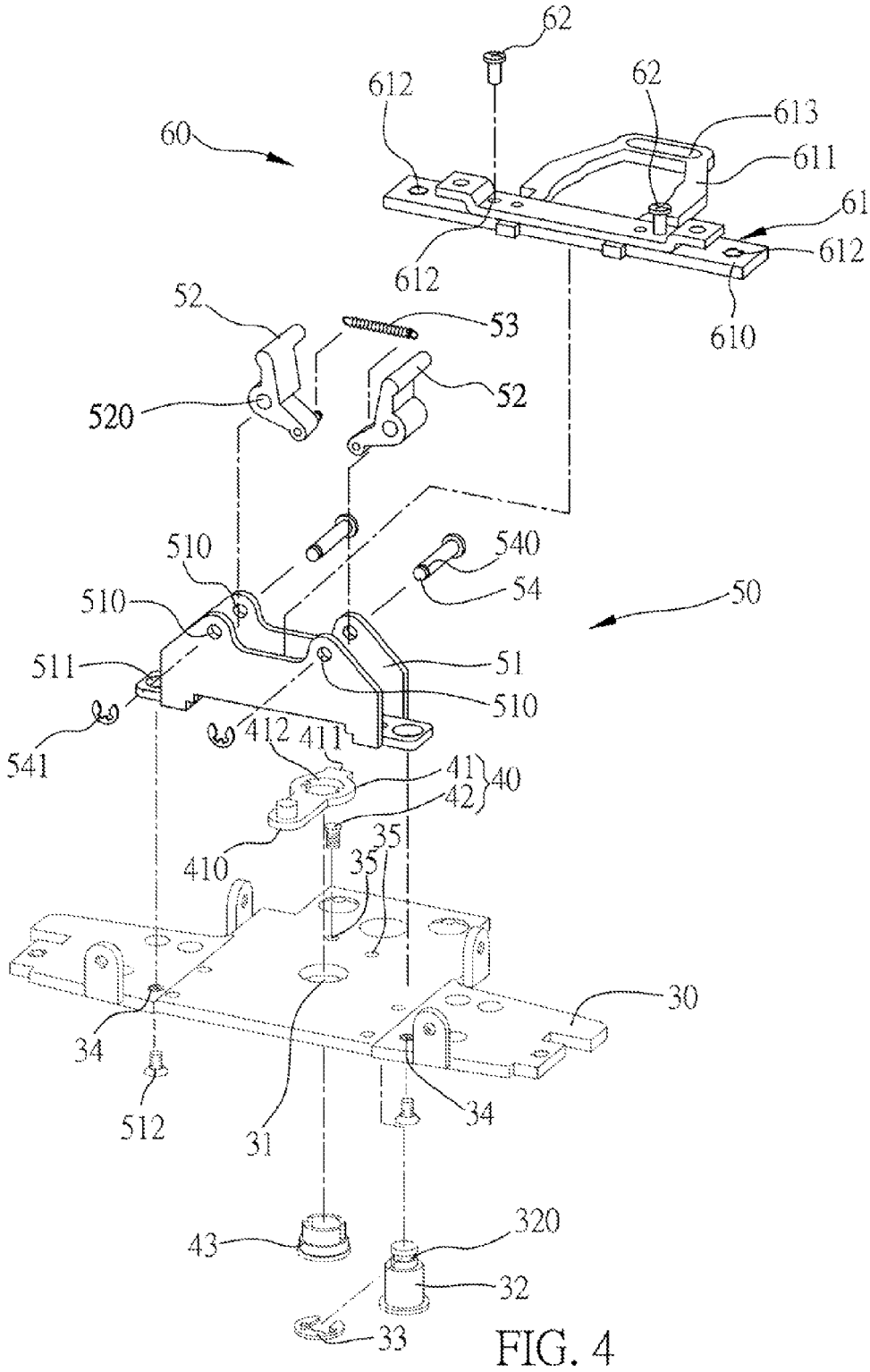
FIG. 4 represents a cross sectional exploded view illustrating an unlock transmission mechanism for escape doors according to the present invention.

According to the aspect of the present invention, as shown in FIG. 4, the base 30 is in a convex shape and has a pivot aperture 31 disposed at the center thereof, the top of the convex base 30 having a limiting protrusive cylinder 32 disposed thereon, wherein one end of the limiting protrusive cylinder 32 is connected to the base 30 while the other end thereof has a concave groove 320 formed thereon and surrounding the whole cylinder body. A C-shaped ring 33 is disposed to cover the concave groove 320 and serves as a fixing element, a fastening aperture 34 being disposed on each of the two rib portions of the convex base 30 respectively, and two limiting apertures 35 being disposed at the center of the pivot hole 31 near the tip of the convex base 30.

According to the aspect of the present invention, the first drive unit 40 is comprised of a driving block 41 and a limiting member 42 (which is a locking screw in this embodiment). The driving block 41 comprises a driving portion 410, a pivot portion 412 and a limiting portion 411, wherein two opposite ends of the pivot portion 412 each connect with the driving portion 410 and the limiting portion 411, respectively. The driving block 41 is pivoted onto the base 30 by penetrating through the pivot portion 412 and the pivot aperture 31 formed on the base 30 via a pivot portion 43, and the limiting portion 411 of the driving block 41 is positioned close to the limiting aperture 35. The locking screw 42 is screwed onto one of the limiting apertures 35 and can block the limiting portion 411 of the driving portion 41 to limit rotation of the driving block 41 within a limited range. The lockup limiting aperture 35 may be disposed according to the orientation of installation of the unlock transmission mechanism 2.

According to the aspect of the present invention, the transmission member 60 is comprised of a sliding block 61 slidably disposed on the base and a detent portion 62 (which is a blocking cylinder 62 in this embodiment) disposed on the sliding block 61, wherein the sliding block 61 has a ring-shaped frame portion 611 and a plane portion 610 disposed on the frame portion 611. The ring-shaped frame portion 611 is in the shape of a ring and connected to the lower portion of the plane portion 610 to constitute the sliding block 61. Each of the two ends of the plane portion 610 is formed with a through aperture 612 respectively for a blocking cylinder 62 to be disposed therein. The blocking cylinder 62 may include a corresponding through aperture 612 according to the installation orientation of the unlock transmission mechanism 2. A limiting groove 613 in a slit shape is disposed on the ring-shaped frame portion 611 at a position away from the plane portion 610.

According to the aspect of the present invention, the transmission member 60 is slidably disposed on the base 30 after the limiting groove 613 is covered on the limiting protrusive cylinder 32 and the C-shaped ring 33 is coupled to the concave groove of the limiting protrusive cylinder 32, thereby positioning the driving block 41 of the first drive unit 40 in the ring-shaped frame portion 611 and connecting the driving portion 410 to an inner edge of the frame portion 611, such that the driving block 41 can rotate along the inner edge of the frame portion 611 and move relative to the transmission member 60.

According to the aspect of the present invention, the second drive unit 50 consists of a base body 51 disposed on the base 30 and covering the plane portion 610, and two turning portions 52 pivoted onto the base 30 at opposite positions to push and move the detent portion 62 by rotating at least one side of the turning portions 52. The base body 51 is formed with a through aperture 510 and a fixing aperture 511 at symmetrical positions, and is fastened on the base 30 and disposed to cover on the transmission mechanism 60 after the two fixing members 512 (which in this embodiment are screws) are screwed into the fixing aperture 511 and the fixing aperture 34 formed on the base 30. Each of the two turning portions 52 has a pivot aperture 520 formed at its curving portion and is pivoted to the base body 51 in a counter-arrow (< >) manner having concave openings thereof disposed to be opposite to one another. Each of the two turning portions 52 is pivoted to the two sides of the base body 51 respectively after a fixing cylinder 54 having a concave groove 540 formed at two end portions thereof is penetrated through the pivot aperture 520 formed on the turning portion 52 and the through aperture 510 formed on the base body 51, and also the C-shaped ring 541 is covered on the concave groove 540. Moreover, each end of the two turning portions 52 close to the inside of the base body 51 connects to the two sides of a spring 53 respectively, enabling the two turning portions 52 to rotate back to its original positions by inherent elasticity of the spring 53 when an end of the two turning portions 52 close to the inside of the base body 51 is spread outwardly and stretches the spring 53. Further, when the two turning portions 52 rotate, one of the two turning portions 52 close to the inside of the base body 51 pushes the blocking cylinder 62 of the transmission mechanism 60 to move relative to the transmission mechanism 60.

Figure 5:
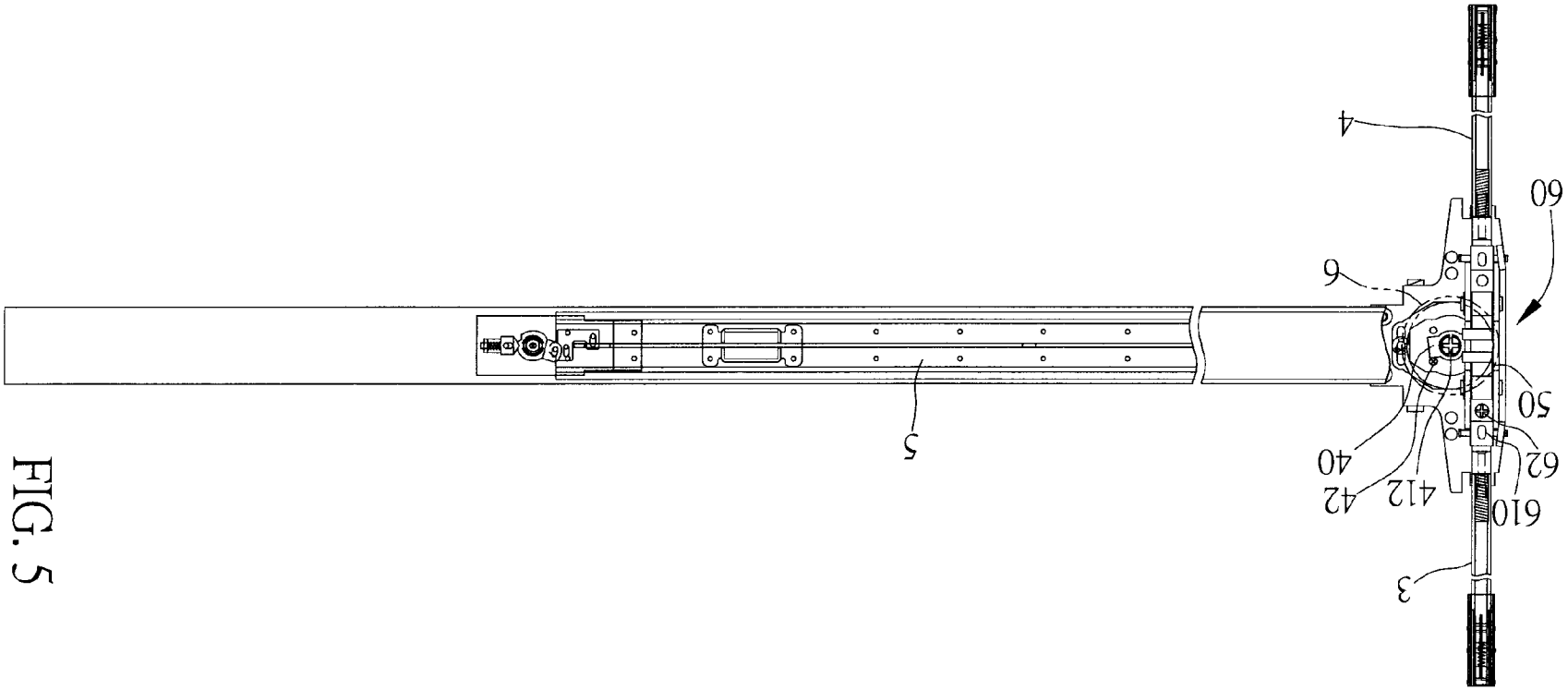
FIG. 5 represents a top view illustrating an unlock transmission mechanism for escape doors according to the present invention connected with other structures of the escape door.

According to the aspect of the present invention, the transmission member 60 and the plane portion 610 disposed at two ends of the unlock transmission mechanism 2 are each connected to the upper bolt link mechanism 3 and the lower bolt link mechanism 4 respectively, as shown in FIG. 5. The door handle mechanism 6 is connected to the pivot portion 412 of the first drive unit 40, and a push door handle mechanism 5 is connected to the two turning portions 52 of the second drive unit 50, such that when the door handle mechanism 6 is rotated or the push door handle mechanism 5 is pressed, the unlock transmission mechanism 2 is actuated to move relative to the upper bolt link mechanism 3 and the lower bolt link mechanism 4.

Figure 6:
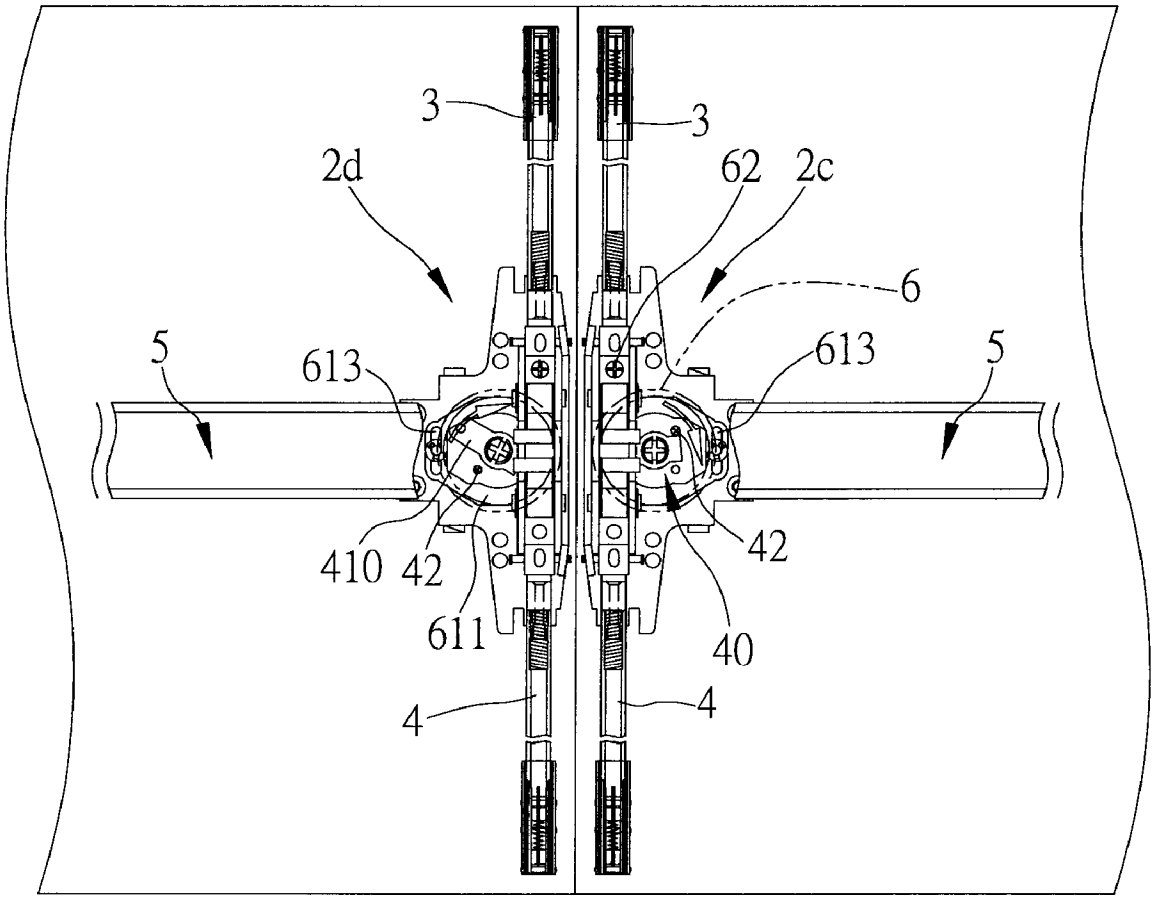
FIG. 6 represents a perspective view illustrating the unlock transmission mechanism for escape doors according to the present invention in coordination with a mated door handle mechanism of similar rotating orientation and assembled with the escape door.

As shown in FIG. 6, when the unlock transmission mechanism 2*c*, 2*d* for escape doors of the present invention is assembled with an escape door at opposite directions, the locking screws 42 disposed therein are locked at a different position than the blocking cylinder 62, and also the driving block 41 is connected to the ring-shaped frame portion 611 at a different position, thereby eliminating the need to replace the door handle mechanism 6 for being installed in an escape door having different installation orientation.

In contrast to conventional escape door locks that are built to install and coordinate with a mated door handle mechanism at a fixed direction, the unlock transmission mechanism for escape doors of the present invention utilizes a limit function in position and the direction changeability of the driving block and the frame portion to actuate an inner edge of the frame portion to cooperate with door handles having different rotation orientation, thereby achieving the purpose of multi-directional installation of the door lock with door handle mechanisms of mated structures and eliminating the necessity to replace an existing door handle mechanism because the design limitation on the fixed installation orientation as encountered in the prior art. Accordingly, the present invention improves and offers advantages over prior techniques by providing a multi-directional unlock transmission mechanism that helps reduce costs effectively.

It will be understood that the invention may be embodied in other specific forms without departing from the spirit or central characteristics thereof. The present examples and embodiments, therefore, are to be considered in all respects as illustrative and not limitive, and the invention is not to be limited to the details given herein.

The invention claimed is:

1. An unlock transmission mechanism for moving a pair of latches of an escape door, comprising:

a base;

a transmission member having a sliding block slidably positioned on the base, and a detent portion formed on the sliding block, wherein the sliding block has a ring-shaped frame portion and a plane portion having an elongated groove and a plane portion disposed on the frame portion;

a first drive unit having a driving block pivoted on the base corresponding to the frame portion by a first actuator from one side of the escape door;

a second drive unit having a base body disposed on the base and covering the plane portion, and two turning portions pivoted on the base at opposite positions by a second actuator from the other side of the escape door to push and move the detent portion by rotating at least one side of the turning portion; and a limiting unit to allow the mounting of the mechanism in either a right or a left side escape door, the limiting unit having a pair of limiting apertures formed on the base, a limiting member disposed on a respective limiting aperture depending on the side of the escape door to limit movement of the driving block depending on the side of the escape door, and a limiting cylinder positioned on an end of the elongate groove to position the driving block on the frame depending on the side of the escape door.

2. The unlock transmission mechanism of claim 1, wherein the limiting member is disposed at an upper position corresponding to the direction in which the base is disposed.

3. The unlock transmission mechanism of claim 1, wherein the driving block has a driving portion pivoted on the base, a limiting portion and a pivot portion having two ends thereof each connected to the driving portion and the limiting portion, respectively.

4. The unlock transmission mechanism of claim 3, wherein the driving portion pushes the sliding block by rotation to move relative to the transmission member.

5. The unlock transmission mechanism of claim 3, wherein the rotating range of the driving block is limited by a coupling of the detent portion of the first drive unit to the limiting portion.

6. The unlock transmission mechanism of claim 1, wherein the turning portions of the second drive unit are arrow (<) shaped protrusions and are pivoted to the base body via the turning point of the arrow (<) shaped turning portions.

7. The unlock transmission mechanism of claim 1, further comprising an elastic element connected to an end of each of the two turning portions to allow for flexible positioning.

8. The unlock transmission mechanism of claim 7, wherein the elastic element is a spring.

9. The unlock transmission mechanism of claim 1, wherein the elongate groove is connected to the base for limiting the moving range of the sliding block.

* * * * *